US009490065B2

(12) United States Patent
Wetteland

(10) Patent No.: US 9,490,065 B2
(45) Date of Patent: Nov. 8, 2016

(54) HIGH VOLTAGE TRANSFORMER

(75) Inventor: Oyvind Wetteland, Stavanger (NO)

(73) Assignee: Zaptec IP AS, Stavanger (NO)

( * ) Notice: Subject to any disclaimer, the term of this patent is extended or adjusted under 35 U.S.C. 154(b) by 0 days.

(21) Appl. No.: 13/148,710

(22) PCT Filed: Feb. 22, 2010

(86) PCT No.: PCT/NO2010/000069

§ 371 (c)(1),
(2), (4) Date: Sep. 27, 2011

(87) PCT Pub. No.: WO2010/095955

PCT Pub. Date: Aug. 26, 2010

(65) Prior Publication Data

US 2012/0007706 A1 Jan. 12, 2012

(30) Foreign Application Priority Data

Feb. 23, 2009 (NO) ..... 20090825

(51) Int. Cl.

| | |
|---|---|
| ***H01F 27/28*** | (2006.01) |
| ***H01F 27/10*** | (2006.01) |
| ***H01F 38/16*** | (2006.01) |
| ***H01F 27/38*** | (2006.01) |
| ***H01F 30/04*** | (2006.01) |
| *H01F 27/34* | (2006.01) |

(52) U.S. Cl.

CPC ..... *H01F 38/16* (2013.01); *H01F 27/38* (2013.01); *H01F 30/04* (2013.01); *H01F 27/10* (2013.01); *H01F 27/34* (2013.01); *H01F 2027/2833* (2013.01)

(58) Field of Classification Search

CPC ..... H01F 27/38; H01F 27/10; H01F 27/34; H01F 30/04; H01F 38/16; H01F 2027/2833

USPC ..... 336/170, 57, 58, 199, 206, 220–222, 336/180, 186

See application file for complete search history.

(56) References Cited

U.S. PATENT DOCUMENTS

| | | | | |
|---|---|---|---|---|
| 1,680,910 A | | 8/1928 | Pfiffner | |
| 1,874,563 A | * | 8/1932 | Martin | 363/68 |
| 2,570,701 A | * | 10/1951 | Martin | 333/20 |
| 3,360,754 A | * | 12/1967 | Gerdiman | 336/170 |

(Continued)

FOREIGN PATENT DOCUMENTS

| | | |
|---|---|---|
| CN | 2648566 Y | 10/2004 |
| WO | 2007/045275 A1 | 4/2007 |

OTHER PUBLICATIONS

International Search Report for parent application PCT/NO2010/000069, having a mailing date of Jun. 22, 2010.

(Continued)

*Primary Examiner* — Mangtin Lian
(74) *Attorney, Agent, or Firm* — Andrus Intellectual Property Law, LLP

(57) ABSTRACT

A high voltage transformer for cascade coupling wherein the high voltage transformer comprises a primary winding, a high voltage winding and a transformer core, and wherein the primary and high voltage windings encircles concentrically at least a part of the transformer core, and wherein the high voltage transformer is provided with a secondary winding, as the high voltage winding comprises one or more single layers connected in parallel.

10 Claims, 6 Drawing Sheets

(56) References Cited

U.S. PATENT DOCUMENTS

| | | | | | |
|---|---|---|---|---|---|
| 3,419,837 | A | * | 12/1968 | Marshall | 336/212 |
| 3,448,340 | A | * | 6/1969 | Lewis | 361/37 |
| 3,579,078 | A | | 5/1971 | Cronin et al. | |
| 3,579,165 | A | * | 5/1971 | Johnson | 336/170 |
| 3,675,175 | A | | 7/1972 | Dutton | |
| 3,678,429 | A | * | 7/1972 | Collin | H01F 38/18 336/170 |
| 4,023,091 | A | | 5/1977 | Fujita et al. | |
| 4,270,111 | A | | 5/1981 | Meyer | |
| 4,518,941 | A | | 5/1985 | Harada | |
| 5,216,356 | A | * | 6/1993 | Owen | 323/361 |
| 5,847,518 | A | * | 12/1998 | Ishiwaki | 315/276 |
| 5,912,553 | A | * | 6/1999 | Mengelkoch | 323/309 |
| 6,838,968 | B2 | * | 1/2005 | Nick et al. | 336/57 |
| 7,274,281 | B2 | * | 9/2007 | Sugioka | 336/170 |
| 2003/0112111 | A1 | * | 6/2003 | Bolotinsky | H01F 27/25 336/170 |

OTHER PUBLICATIONS

Written Opinion of the International Searching Authority for parent application PCT/NO2010/000069, having a mailing date of Jun. 22, 2010.

International Preliminary Report on Patentability for parent application PCT/NO2010/000069, having a completion date of Jun. 7, 2011.

Notice of Completing Formalities for Patent Registration for CN201080013698.0 dated Jun. 3, 2015.

* cited by examiner

I–I

HIGH VOLTAGE TRANSFORMER

CROSS-REFERENCE TO RELATED APPLICATIONS

This application is the U.S. national stage application of International Application No. PCT/NO2010/000069, filed Feb. 22, 2010, which International application was published on Aug. 26, 2010 as International Publication No. WO 2010/095955 A1 in the English language and which application is incorporated herein by reference. The International application claims priority of Norwegian Patent Application No. 20090825, filed Feb. 23, 2009, which application is incorporated herein by reference.

BACKGROUND

This invention relates to a high voltage transformer. More particularly it concerns a high voltage transformer for cascade connection where the high voltage transformer comprises a primary winding, a high voltage winding and a transformer core and wherein the primary winding and the high voltage winding encircles at least a part of the transformer core.

In the description the term "good high frequency qualities" is used. By this is meant that a so-called "pulse transformer" having relatively low coupling inductance between the primary and secondary windings, relatively low so-called "skin effect" and "proximity effect" in the windings at relatively high frequencies, relatively low parasitic capacitance internally in the windings and relatively low capacitance between windings and between windings and the transformer core. This concerns particularly the high voltage winding. Said physical parameters are well known to a person well versed in the art and are therefore not explained further.

For a pulse transformer being run near to saturation, typical for inverters, the practical expression:

$$U=4B_s*f*n*A_e$$

is used, where $B_s$=magnetic flux density (saturation), U=the top value of the voltage over the winding, f=working frequency, n=number of turns and $A_e$=effective cross-section of the transformer core.

From the expression appears that a high output voltage may be achieved at a high frequency, high saturation field strength, large iron cross-section and many turns.

In case of little room available it is often easiest to increase the frequency. To avoid too great eddy-current losses one then has to use core materials having low electrical conductivity such as ferrite, iron powder or so-called "tape wound cores".

A method for feeding the transformer a relatively high frequency comprises a so-called SMPS—(Switched Mode Power Supply) technique. The input power is according to this technique converted to a preferably square pulse high frequency input voltage to the high voltage transformer.

A prior art high voltage transformer has as mentioned, due to its mode of operation, a relatively high number of turns in the secondary winding. This causes an increased secondary capacitance in that the windings with many layers of relatively thin winding wire have less mutual average distance from each other than in a transformer where the winding wire is of larger diameter.

The many turns of the secondary winding requires relatively much space and thereby leads to the transformer core and the primary winding being relatively large. In addition large insulation distances are required between high voltage winding, primary winding and transformer core. The transformer thus being relatively large leads to increased losses in transformer windings and also that high voltage transformers of this kind have a relatively low coupling factor. A low coupling factor may be modelled as a relatively large coupling inductance. The reason is that a relatively large distance between the primary and secondary windings leads to poor magnetic coupling between them.

This unintentional and in the main unavoidable parasitic coupling inductance will, in the same way as the secondary capacitance and in combination with the secondary capacitance, influence the current in the transformer. By the coupling inductance limiting the high frequent current, and also that most of this current is used to drive internal parasitic capacitance in the secondary winding, a clear limitation in the power output from the secondary winding at high frequencies arises. High frequency transformers of this kind have thus a relatively narrow bandwidth, i.e. the highest driving frequency the high frequency transformer can work at.

Known low voltage SMPS technique can produce voltages up to the order of 1 kV. At higher voltages it is necessary to adapt the transformer by means of per se known techniques as voltage multiplication, cascade coupled high frequency transformers, layered winding techniques or so-called "resonant switching" to compensate for the relatively narrow bandwidth in a high frequency transformer.

Common for all these techniques is that they only to a limited extent overcome the drawbacks at the same time as they complicate and thereby raise the price of the complete high frequency converter.

It is known to reduce the number of layers in a transformer to be able to achieve improved transformer properties. U.S. Pat. No. 7,274,281 deals with a transformer for a discharge lamp such as a fluorescent tube where the transformer is provided with two series connected primary windings that may be constituted by one winding layer.

U.S. Pat. No. 1,680,910 describes a transformer for cascade connection. This one is however not suitable for SMPS because it has a high capacitance in the windings and a low coupling factor.

U.S. Pat. No. 4,518,941 shows a transformer that is suitable for SMPS but where the rated transformer ratio is one to one. The transformer according to this document is not suitable as a high voltage transformer.

U.S. Pat. No. 3,678,429 shows a high voltage transformer for cascade coupling wherein there besides a primary winding and a secondary winding is arranged a winding for cascade coupling. Due to the design of the high voltage winding the transformer according to U.S. Pat. No. 3,678,429 is not suitable for SMPS.

U.S. Pat. No. 3,579,078 deals with a one-step transformer coupled to a so-called "Voltage Quadrupler". The transformer does not however solve the relevant technical problem as one does not achieve a high enough voltage in one step.

From WO 2007045275 it is known to use two secondary windings for cascade coupling with a so-called "flyback-convertor" to achieve a stable output voltage in each cascade step.

Prior art does not exhibit transformers having suitable high voltage properties and at the same time being suitable for cascade coupling.

SUMMARY

The object of the invention is to remedy or reduce at least one of the prior art drawbacks.

The object is achieved according to the invention by the features stated in the below description and in the following claims.

There is provided a high voltage transformer for cascade coupling where the high voltage transformer comprises a primary winding, a high voltage winding and a transformer core and where the primary and high voltage windings encircles concentrically at least a part of the transformer core, and which is characterised in that the high voltage transformer is provided with a secondary winding as the high voltage winding comprises one single layer or more parallel-connected single layers.

In the high voltage transformer according to the invention the voltage over the primary and the secondary winding is low-tension relative to the high voltage winding. The secondary winding is arranged to carry a larger power than the high voltage winding.

The high voltage winding is also a secondary winding, but the term high voltage winding is used to better differentiate this winding from the relatively low-voltage secondary winding.

By winding the high voltage winding in a tubular single layer, internal parasitic capacitance in the high voltage winding is reduced to a practical minimum. To reduce the resistance in the high voltage winding several layers may be wound one outside of the other where the layers thereafter are connected in parallel, for example in the conductor portions of the high voltage winding. It may be expedient to arrange insulation sheeting, for example polyamide film between the layers. In a multi-layer high voltage winding of this kind, one will still achieve getting the internal capacitance small relative to known high voltage windings being wound back and forth in more layers connected in series.

Between the primary and secondary windings there may be an annular opening for cooling fluid running therethrough. Such an opening between the windings and the transformer core ensures at the same time the necessary insulation distance and results in relatively low capacitance between windings and between windings and the transformer core.

By the high voltage winding being tubularly wound and axially outside the primary winding and also normally concentric with it, a relatively high coupling factor between the windings is achieved. The leak inductance between the windings is thereby almost negligible.

The series resonant frequency $f_s$ of a transformer is given by:

$$\mathrm{Ls_prim} := Lm(1 - k_p^2)$$

$$C_{p_prim} := C_s \cdot \left(\frac{N_{sek}}{N_{prim}}\right)^2$$

$$f_s := \frac{1}{2\pi\sqrt{L_{s_prim} C_{p_prim}}}$$

Where $L_m$ is primary magnetising inductance, $k_p$ is coupling factor, $N_{sek}$ and $N_{prim}$ number of turns on secondary and primary winding respectively. $C_s$ is total parasitic capacitance in the secondary winding. The series resonant frequency is a direct measure of how good the high frequency properties of the transformer are.

According to prior art it is common to fill the so-called winding window of a transformer with windings to reduce resistance and conductor losses. A high voltage winding with its relatively large volume usually takes up a considerable share of this winding window. To arrange a high voltage winding in just one layer is thus violating known principles for transformer design.

Even if according to the invention only one layer is used in the high voltage winding it is necessary to use a relatively large number of turns in the high voltage winding relative to the primary winding to be able to achieve a suitable voltage increase. By the very fact that the high voltage winding should have the same overall length as the primary winding, and that these are limited by the winding window, a relatively thin conductor needs therefore to be used in the high voltage winding. This entails a relatively high resistance in the high voltage winding conductor and that the high voltage winding gets the form of a thin pipe. The relationship is compensated by that the transformer may be made relatively small, whereby the length of each turn is reduced. The resistance is also reduced thereby.

If this kind of high voltage transformer is used in a cascade coupling, the power requirement is reduced in each high voltage winding as shown in the following formula:

$$P_{sek_M} = P_{prim_M}\left(1 - \frac{1}{N}\right)$$

Where M is the number of the relevant step and N is number of steps.

The high voltage winding being wound of a relatively thin winding wire limits the power it can supply. This drawback is compensated to a considerable extent by that a transformer according to the invention has a considerably improved efficiency compared to prior art transformers, and that the thin winding wire makes room for a cooling slit between the windings and between the windings and the transformer core making good cooling and electric insulation between the components possible.

If the transformer according to the invention is used in a cascade coupling as described above, the power trough-put in the high voltage winding is reduced considerably relative to prior art, whereby the drawback with high resistance in the high voltage winding is remedied further. This makes the high voltage transformer according to the invention suitable for feeding from an SMPS.

The high voltage winding may be between the primary winding and the secondary winding in the high voltage transformer.

By connecting a first transformer secondary winding in series with a second transformer primary winding and connecting the high voltage winding of the first transformer in series with the high voltage winding of the second transformer with intermediate rectification, the voltage over the high voltage windings are added while a part of the power between the first transformer and a second transformer is transferred by means of the secondary winding of the first transformer and not via the high voltage winding of the first transformer.

The high voltage apparatus may thus comprise two or more cascade coupled transformers. The power output on the high voltage side thereby divides itself on high voltage windings in more steps, where most of the steps must be rectified before series connection to avoid that the high voltage winding in one step must drive parasitic capacitance in windings in the next step.

That more high voltage windings in this way share the total output power causes that each high voltage winding may be dimensioned for a fraction of the output power, as the number of steps decide the fraction factor.

Increasing the output voltage intentionally further, or to be able to reduce the number of turns to make room for a thicker winding wire, the high voltage winding of the first transformer may cooperate with a voltage multiplier of a per se known kind. The second transformer and further transformers in the cascade coupling may also cooperate with each of their own voltage multiplier.

A high voltage winding with only one layer contributes to an increased insulation distance between the layers in that the high voltage winding takes up little room. The thin tubular design of the windings contributes to good cooling of both windings and transformer core, and renders the transformer possible to handle a relatively high power relative to its physical size. By the inner parts being cooled well in this way, and also that internal heating in one-layer windings is avoided, the transformer is also suitable for use under relatively high ambient temperatures.

More transformers interconnected in a cascade coupling according to the invention is suitable both for high voltage direct current and a combined direct and alternating current output, as one step may be designed without rectification. Since primary driving voltage is conducted via low voltage windings through all steps, it is possible to use this alternating voltage to drive one or more additional transformers in a high voltage cascade having differently so rated transformer ratios between the windings to generate different voltages that may be needed in a system. A secondary voltage on the last step may for example drive an additional transformer generating filament voltage for an X-ray tube. If so, this is a separate low voltage alternating voltage or a rectified alternating voltage superimposed on the high voltage.

The transformer of the invention is particularly suitable for use in miniature high voltage power supplies. It occupies relatively little room, puts up with relatively high ambient temperatures and may be formed having a lengthy cylindrical shape, and where there is a need for high voltage direct current or high voltage direct current with superimposed alternating current.

The transformer may thus suit applications such as in petroleum wells, spraying plants, X-ray apparatuses, electrostatic precipitators and non-thermal plasma generating.

BRIEF DESCRIPTION OF THE DRAWINGS

In the following is described an example of a preferred embodiment being illustrated in the accompanying drawings, wherein.

DETAILED DESCRIPTION OF THE DRAWINGS

Figure 1:
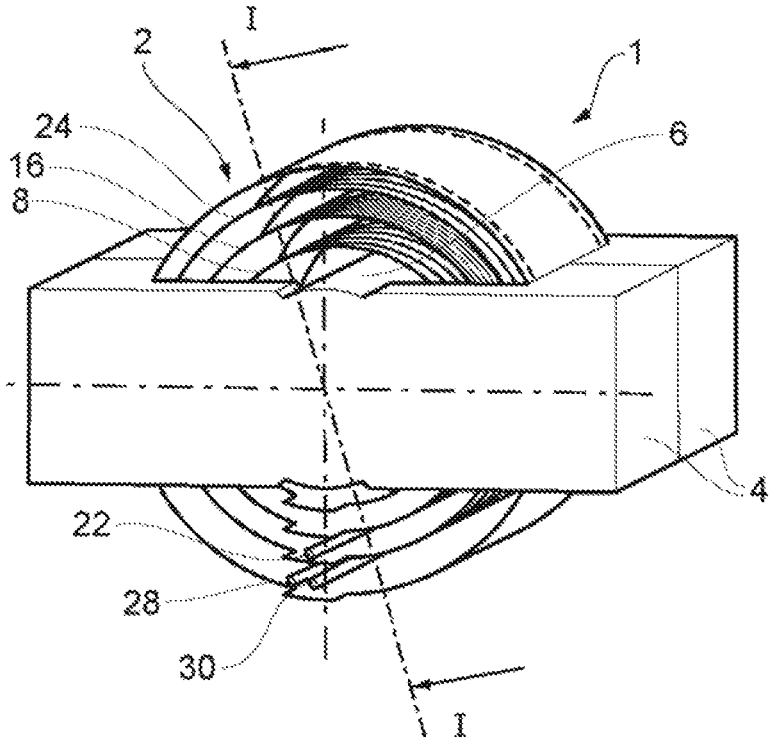
FIG. 1 shows in perspective a high voltage transformer according to the invention.

In the following indexed reference numerals are used when the reference numeral relates to a specific component from several components of the same kind such as transformers. In the drawings are more indexed reference numerals shown without each indexed reference numeral necessarily being mentioned in the description.

In the drawings the reference numeral 1 indicates a high voltage apparatus with a transformer 2. The transformer 2 comprises two opposing E-shaped ferrite transformer cores 4 where about and spaced from the mid portions 6 of the transformer cores 4 is coiled a primary winding 8 on a cylindrical, insulating primary sleeve 10. The first conductor end portion 12 and the second conductor end portion 14 of the primary winding 8 are led out on the same end portion of the primary winding 8.

A high voltage winding 16 encircles the primary winding 8 at a radial distance. The high voltage winding 16 is wound in one layer on a cylindrical, insulating high voltage sleeve 18. The first conductor end portion 20 and the second conductor end portion 22 of the high voltage winding 16 are led out on one each end portion at the high voltage winding 16.

A secondary winding 24 encircles the high voltage winding 16 at a radial distance. The secondary winding 24 is wound on a cylindrical, insulating secondary sleeve 26. The first conductor end portion 28 and the second conductor end portion 30 of the secondary winding 24 are led out on the same end portion at the secondary winding 24.

Figure 2:
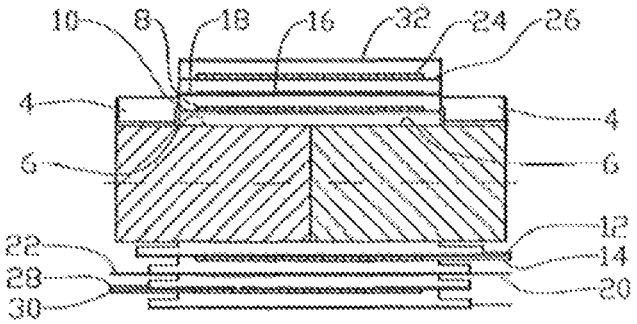
FIG. 2 shows a section I-I in FIG. 1.

In FIGS. 1 and 2 the secondary winding 24 is also encircled by a static-shield winding 32 connected to the transformer core 4. Preferably the static-shield winding 32 encircles most of the secondary winding 24, but not completely encircling this, as this if so would constitute a short-circuit turn for the transformer 2. The static-shield winding 32 is arranged to improve the high voltage insulation relative to in FIGS. 1 and 2 adjacent and not shown components.

The primary winding 8 and the secondary winding 24 have approximately the same number of turns, while the high voltage winding 16 has a considerably higher number of turns.

The different windings are interconnected by means of not shown per se known circuit board electrical path.

Figure 3:
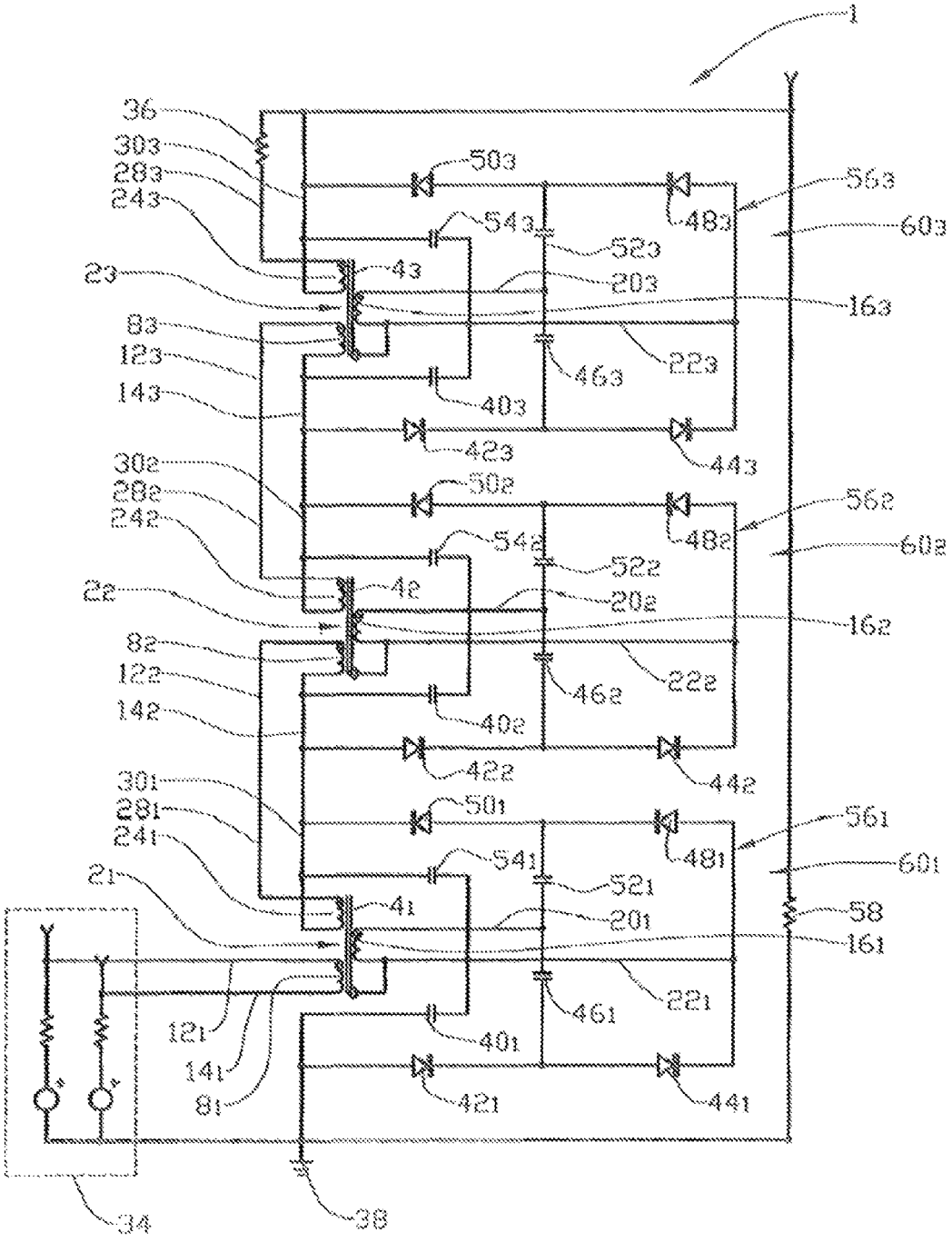
FIG. 3 shows a circuit diagram for a cascade coupled high voltage apparatus with voltage multipliers.

The transformer 2 is suitable for being fed with an inverted direct voltage from an SMPS power source 34 connected to the first conductor end portion 12 and the second conductor end portion 14 of the primary winding 8 corresponding to what is shown in the diagram in FIG. 3. Thus an alternating voltage may be taken out on the first conductor end portion 20 and the second conductor end portion 22 of the high voltage winding 16 and an alternating voltage corresponding to the feed voltage on the first conductor end portion 28 and the second conductor end portion 30 of the secondary winding 24.

The circuit diagram in FIG. 3 shows that the high voltage apparatus 1 in this embodiment besides a first transformer $\mathbf{2}_1$ also comprises a second transformer $\mathbf{2}_2$ and a third transformer $\mathbf{2}_3$. The second transformer $\mathbf{2}_2$ and the third transformer $\mathbf{2}_3$ have the same design as the first transformer $\mathbf{2}_1$.

The SMPS power source 34 is connected to the first conductor end portion $\mathbf{12}_1$ and the second conductor end portion $\mathbf{14}_1$ of the primary winding $\mathbf{8}_1$ of the first transformer $\mathbf{2}_1$. The secondary winding $\mathbf{24}_1$ of the first transformer $\mathbf{2}_1$ is by means of the first conductor end portion $\mathbf{28}_1$ connected to the first conductor end portion $\mathbf{12}_2$ on the primary winding $\mathbf{8}_2$ of the second transformer $\mathbf{2}_2$. The second conductor end portion $\mathbf{30}_1$ so of the secondary winding $\mathbf{24}_1$ is correspondingly connected to the second conductor end portion $\mathbf{14}_2$ of the primary winding $\mathbf{8}_2$.

The same applies between the second transformer $2_2$ and the third transformer $2_3$. The first conductor end portion $28_2$ of the secondary winding $24_2$ is connected to the first conductor end portion $12_3$ of the primary winding $8_3$ and the second conductor end portion $30_2$ of the secondary winding $24_2$ is connected to the second conductor end portion $14_3$ of the primary winding $8_3$.

The first conductor end portion $28_3$ and the second conductor end portion $30_3$ of the secondary winding $24_3$ of the third transformer $2_3$ are connected together to a so-called dummy load 36 having a relatively large electrical resistance. All the second conductor end portions $22_1$, $22_2$, $22_3$ of the high voltage windings $16_1$, $16_2$, $16_3$ are connected to the corresponding transformer core $4_1$, $4_2$, $4_3$ constituting local 0-levels.

The SMPS power source 34 is earthed to an earth point 38.

A first condenser $40_1$ is connected to the first transformer 21 between the second conductor end portion $22_1$ and the earth point 38 of the high voltage winding $16_1$. A first anode of diode $42_1$ is also connected to the earth point 38. The first cathode of the diode $42_1$ is connected to the anode of a second diode $44_1$ and via a second condenser $46_1$ to the first conductor end portion $20_1$ of the high voltage winding $16_1$.

The cathode of the second diode $44_1$ is connected to the anode of a third cathode $48_1$ and to the second conductor end portion $22_1$ of the high voltage winding $16_1$ and thereby to the transformer core $4_1$ constituting the local O-point.

The cathode of the third diode $48_1$ is connected to the anode so of a fourth diode $50_1$ and to the first conductor end portion $20_1$ of the high voltage winding $16_1$ via a third condenser $52_1$. The cathode of the fourth diode $50_1$ is connected to the second conductor end portion $30_1$ of the secondary winding $24_1$ and to the second conductor end portion $22_1$ of the high voltage winding $16_1$ via a fourth condenser $54_1$.

The diodes $42_1$, $44_1$, $48_1$, $50_1$ and the condensers $40_1$, $46_1$, $52_1$, $54_1$ thus constitute a voltage multiplier $56_1$ of a per se known design.

The second transformer $2_2$ is correspondingly provided with a second voltage multiplier $56_2$, but here is the first condenser $40_2$ and the anode of the first diode $42_2$ connected to the second connector end portion $14_2$ of the primary winding $8_2$.

In the same way is the third transformer $2_3$ correspondingly provided with a third voltage multiplier $56_3$, where the first condenser $40_3$ and the anode of the first diode $42_3$ is connected to the second connector end portion $14_3$ of the primary winding $8_3$.

A load 58 is connected between the second connector end portion $30_3$ of the secondary winding $24_3$ of the third transformer $2_3$ and the earth point 38.

The first transformer $2_1$ constitutes together with the first voltage multiplier $56_1$ a first step $60_1$ in the high voltage apparatus 1. The second transformer $2_2$ constitutes together with the second voltage multiplier $56_2$ a second step $60_2$ and the third transformer $2_3$ constitutes together with the third voltage multiplier $56_3$ a third step $60_3$.

When a drive voltage, here in the form of an inverted direct voltage from the SMPS power source 34, is supplied to the primary winding $8_1$ of the first transformer, a share of the power is taken out in the high voltage winding $16_1$ and the balancing part out in the secondary winding $24_1$. The secondary winding $24_1$ also contributes to stabilise the voltage over the first step $60_1$. The ratio of the power output in the high voltage winding $16_1$ to the secondary winding $24_1$ is controlled as described in the general part of the description.

The alternating voltage from the secondary winding $24_1$ and the rectified high voltage from the high voltage winding $16_1$ in the first step $60_1$ is conducted to the second step $60_2$ via a common conductor as it is shown in the circuit diagram in FIG. 3. The high voltage winding $16_3$ does not conduct the high voltage to further steps. Neither does the secondary winding $24_3$ conduct primary drive voltage to further steps. Nevertheless is this high voltage output voltage connected via the secondary winding $24_3$ for the internal charging and voltage split in the transformer $2_3$ to be equal to the rest of the transformers $2_1$, $2_2$, and to be able to build the transformer $2_3$ with appurtenant components equal to the rest of the transformers $2_1$, $2_2$.

To get the highest possible voltage over each step 60 with the fewest possible turns in the high voltage windings $16_1$. $16_2$, $16_3$, each step $60_1$, $60_2$, $60_3$ comprise their respective voltage multipliers $56_1$, $56_2$, $56_3$.

The connection shown effects that there in the first step $60_1$ arises a doubling of negative top voltage at the anode of the first diode $42_1$ relative to the top voltage of the high voltage winding $16_1$, and a doubling of positive voltage on the cathode of the fourth diode $50_1$ relative to the top voltage of the high voltage winding $16_1$. The first condenser $40_1$ stores and stabilises the double negative voltage while the fourth condenser $54_1$ stores and stabilises the double positive voltage. The first condenser $40_1$ and the fourth condenser $54_1$ are connected to the local O-level, which also the second conductor end portion $22_1$ of the high voltage winding $16_1$ and the transformer core $4_1$ are connected to.

The third condenser $52_1$, the third diode $48_1$ and the fourth diode $50_1$ generate a double positive top voltage while the second condenser $46_1$ together with the first diode $42_1$ and the second diode $44_1$ generate a double negative top voltage.

The rectified high voltage from the first step $60_1$ is fed further into the second step $60_2$ where it is added to the voltage from the second step $60_2$ and on to the third step $60_3$ wherefrom the summed up voltage from the three steps $60_1$, $60_2$, $60_3$ are supplied to the load 58.

Figure 4:
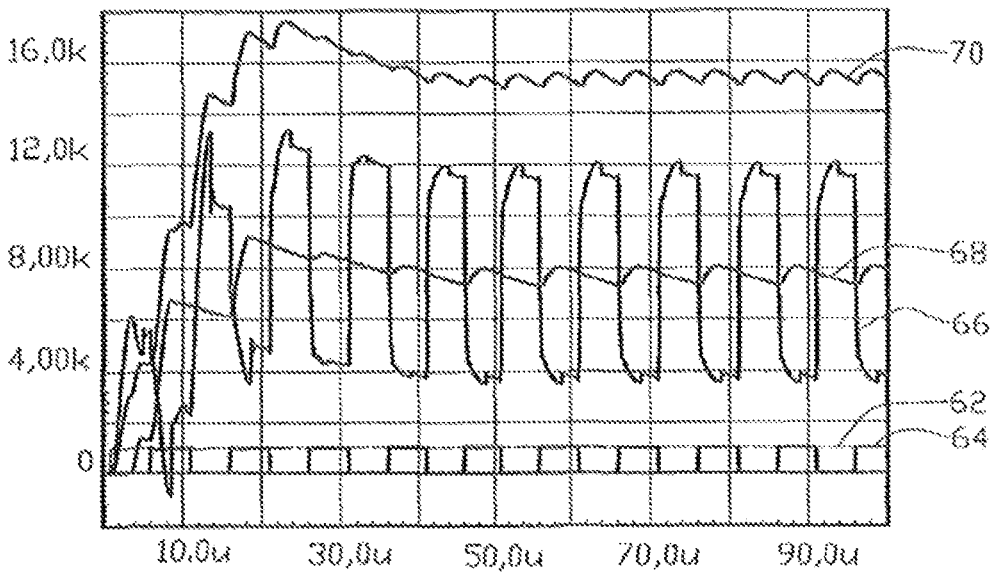
FIG. 4 shows a printout of a typical voltage signal level during operation in the first step according to the circuit diagram in FIG. 3.

In FIG. 4 is shown a graph wherein the abscissa shows the time in μs, and the ordinate shows the voltage in Volt. The curves 62 and 64 show primary voltage at 100 kHz and 1 kV amplitude. The curve 62 is shown in dotted line and in a narrower line compared to the curve 64. The curve 66 shows alternating voltage over the high voltage winding $16_1$. The curve 68 shows a relatively stable voltage at local O-level, i.e. on the second conductor end portion $22_1$ of the high voltage winding $16_1$, and the curve 70 shows a doubling of positive top voltage on the cathode of the fourth diode $50_1$ compared to the local O-level.

Negative double top voltage is in the first step $60_1$ connected to the earth point 38 being the real 0 in the graph.

The curves 62-70 in FIG. 4 concerns a high voltage apparatus 1 wherein the voltage over each step 60 is 17 kV and the voltage output from the high voltage apparatus 1 is 51 kV. The load 58 is 500 kohm, and output power is about 5 kW.

Figure 5:
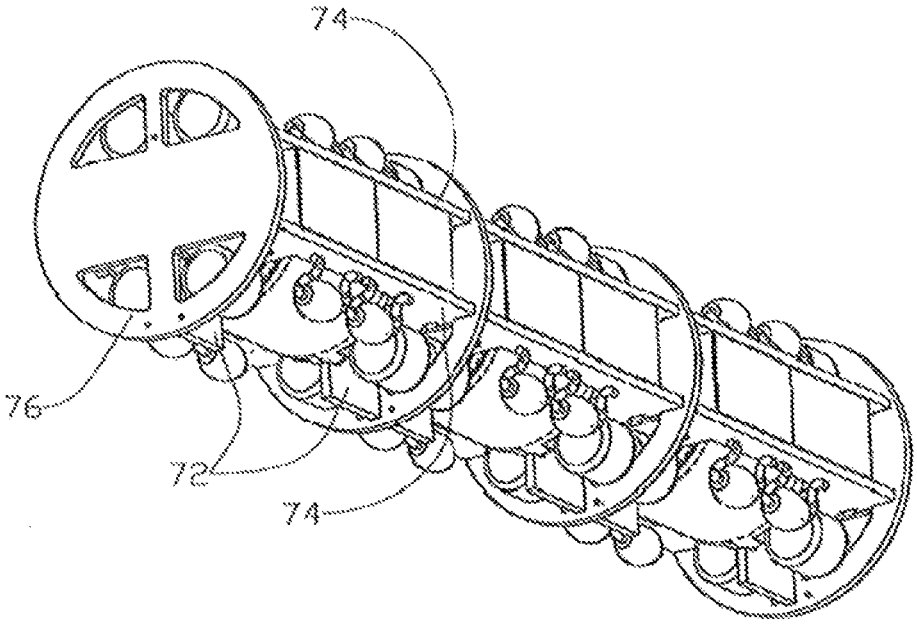
FIG. 5 shows in perspective a high voltage apparatus according to the circuit diagram in FIG. 3 for enclosure in a cylindrical cavity.

A practical construction of the high voltage apparatus 1 for placement in a not shown cylindrical space is shown in FIG. 5. Connector paths are not shown. The windings 8, 16 and 24 are connected to a winding circuit card 72 wherefrom the not shown connectors run via the not shown connector paths via plate card 74 and disc card 76 as described above to the rest of the components of the high voltage apparatus 1.

Due to space considerations two condensers connected in parallel in FIG. 5 constitute each condenser in the circuit diagram in FIG. 3. In the same way every diode in the circuit diagram in FIG. 3 is constituted by two diodes connected in series in FIG. 5.

Figure 6:
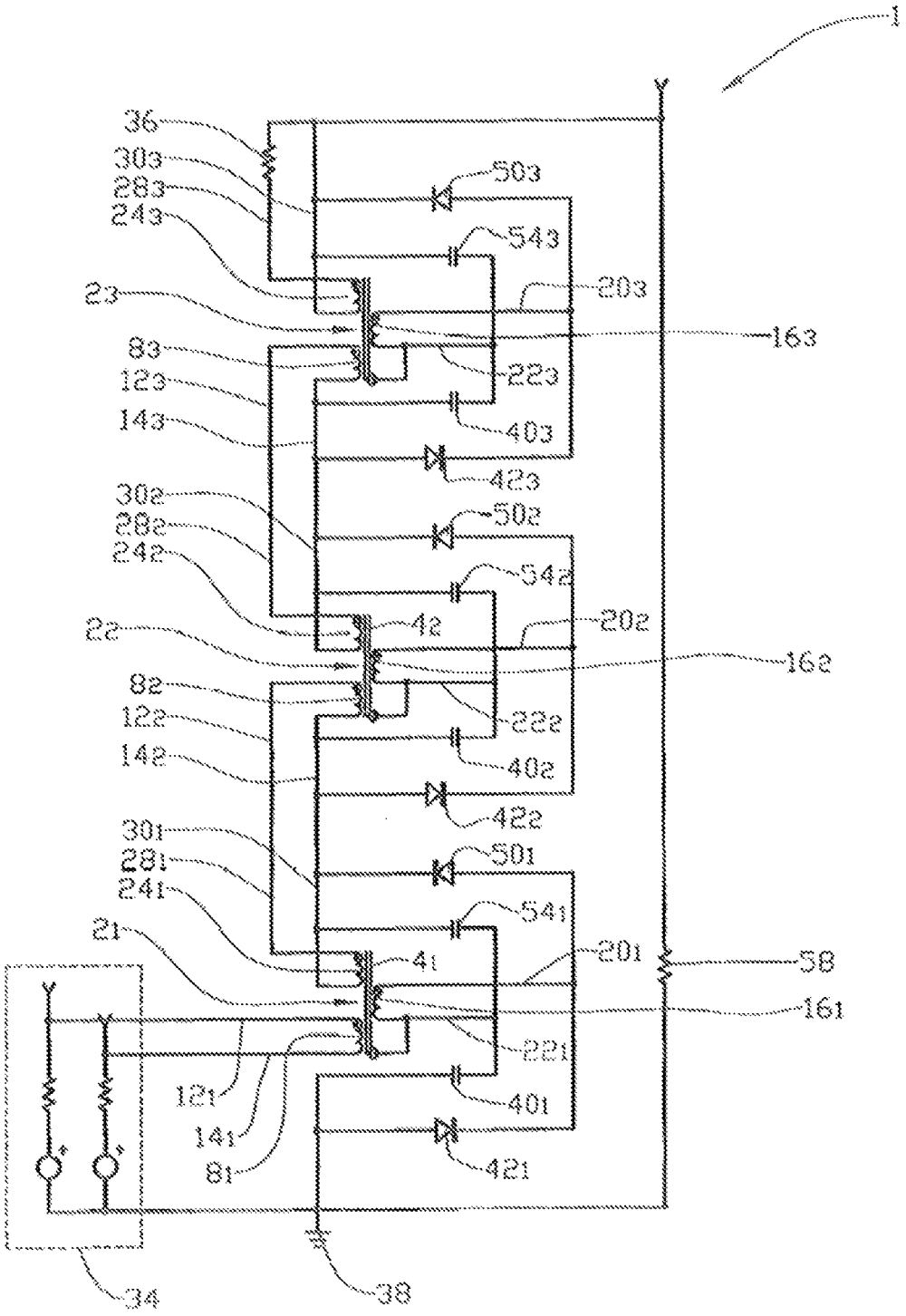
FIG. 6 shows a circuit diagram for a cascade coupled high voltage apparatus in a simplified embodiment.
Figure 7:
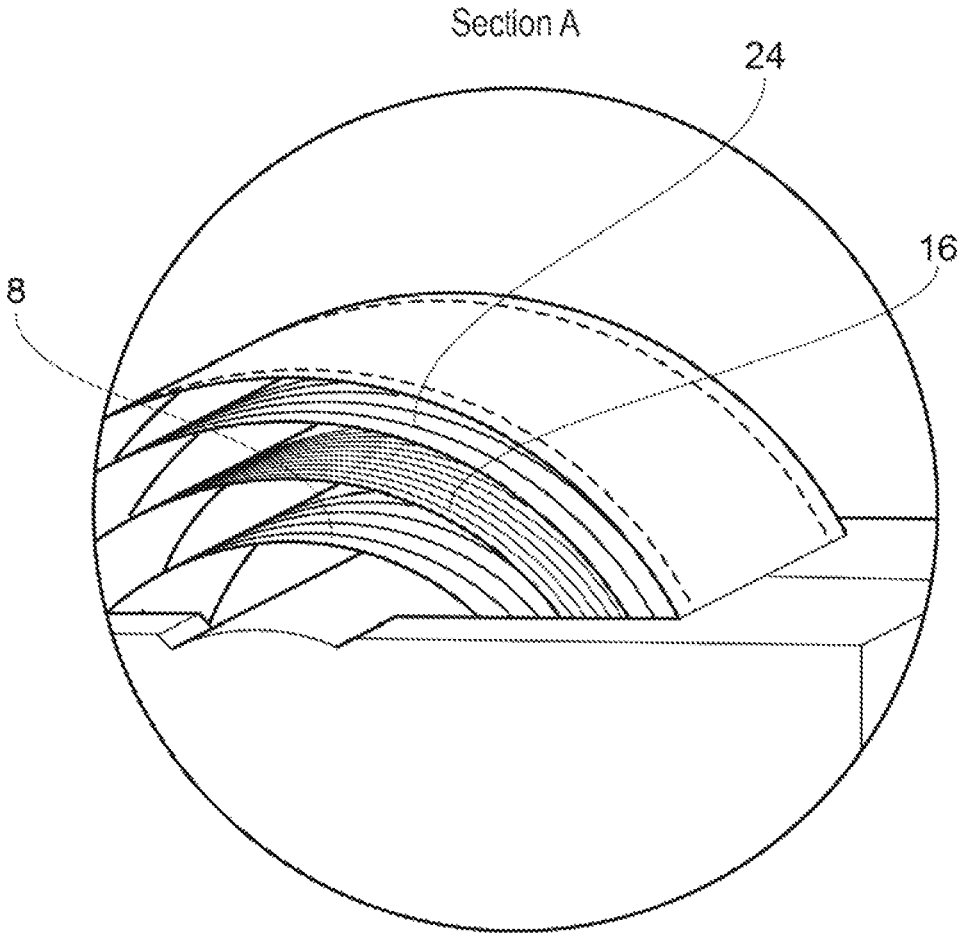
FIG. 7 shows a magnified portion of Section A of Fig. 1.

FIG. 6 shows a simplified embodiment of the high voltage apparatus 1 wherein the voltage multipliers are left out, as the first condensers $\mathbf{40}_1$, $\mathbf{40}_2$, $\mathbf{40}_3$ and the fourth condensers 54 may be constituted by the internal capacitance of the high voltage windings $\mathbf{16}_1$, $\mathbf{16}_2$, $\mathbf{16}_3$.

The high voltage apparatuses 1 in FIGS. 3 and 4 give a positive output voltage. If all diodes are turned, a negative output voltage is given off.

The invention claimed is:

1. A high voltage transformer, the high voltage transformer comprising: a primary winding, a high voltage winding and a transformer core, wherein the primary winding and the high voltage winding encircle concentrically at least a part of the transformer core, and wherein the high voltage winding has a higher number of turns than the primary winding, and comprises one single layer or a plurality of single layers connected in parallel, wherein therebetween the primary winding and the high voltage winding is an annular opening therethrough for providing high voltage insulation distance and passage of cooling fluid, wherein the annular opening is further configured to provide a low capacitance between the primary winding and a secondary winding, and the annular opening is further configured between the primary and secondary windings and the transformer core.

2. A high voltage transformer according to claim 1, wherein the high voltage winding is positioned between the primary winding and the secondary winding.

3. A high voltage transformer according to claim 1, wherein the secondary winding is separated from the high voltage winding.

4. A high voltage transformer according to claim 3, wherein the secondary winding encircles concentrically at least a part of the core.

5. A high voltage transformer according to claim 3, wherein the high voltage winding has a higher number of turns than the secondary winding.

6. A high voltage transformer according to claim 3, wherein the secondary winding is encircled by a static-shield winding connected to the transformer core.

7. A high voltage transformer according to claim 6, wherein an annular static-shield encircles most of, but not completely, the secondary winding.

8. A high voltage transformer according to claim 1, wherein the secondary winding of the first transformer is connected in series with the primary winding of a second transformer and the high voltage winding of the first transformer is connected in series with a high voltage winding of a second transformer.

9. A high voltage transformer according to claim 8, wherein the high voltage winding of one or more first transformers cooperates with a voltage multiplier.

10. A high voltage transformer, the high voltage transformer comprising:

a primary winding, a high voltage winding and a transformer core, wherein the primary winding and the high voltage winding concentrically encircle the transformer core;

wherein the high voltage winding has a higher number of turns than the primary winding and wherein the high voltage winding comprises a single layer or a plurality of single layers connected in parallel; and wherein an annular opening is defined between the primary winding, the high voltage winding, and the transformer core, the annular opening encircling the transformer core and being devoid of supporting structure extending between the primary winding and the high voltage winding so that the annular opening provides a high voltage insulation distance between the primary winding and the high voltage winding, provides a low capacitance between the primary winding and the secondary winding, and allows passage of cooling fluid between the primary winding and the high voltage winding.

* * * * *